US006736655B2

(12) United States Patent
Martin et al.

(10) Patent No.: US 6,736,655 B2
(45) Date of Patent: May 18, 2004

(54) RACK AND PINION ELECTRICAL CONNECTOR WITH OFFSET GEAR TEETH

(75) Inventors: Darryl Craig Martin, Kernersville, NC (US); Wolfgang Hoelscher, Stokesdale, NC (US); Shawn Phillip Tobey, Trinity, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/124,098

(22) Filed: Apr. 17, 2002

(65) Prior Publication Data

US 2003/0199184 A1 Oct. 23, 2003

(51) Int. Cl.[7] ..... H01K 13/62
(52) U.S. Cl. ..... 439/157; 439/372
(58) Field of Search ..... 439/157, 372, 439/152–156, 159, 160

(56) References Cited

U.S. PATENT DOCUMENTS

| | | | |
|---|---|---|---|
| 5,322,448 | A | 6/1994 | Hahn |
| 5,722,843 | A | 3/1998 | Kerckhof et al. |
| 5,833,484 | A | 11/1998 | Post et al. |
| 6,247,966 | B1 | 6/2001 | Klein et al. |
| 6,325,647 | B1 * | 12/2001 | May et al. ..... 439/157 |

FOREIGN PATENT DOCUMENTS

DE 8714016 U 1/1988

OTHER PUBLICATIONS

AMP Customer Drawing C–1355350 Date—Jan. 31, 2000. Micro–Quadlok System, 18 Position Connector Coupling—VDA Interface (Undated) See www.tycoelectronics.com/TE/b . . . =42&RQS=C–1^M–BYPN^B–538^PN–1–1355350–1.

* cited by examiner

*Primary Examiner*—Ross Gushi

(57) ABSTRACT

An electrical connector assembly 2 includes a plug connector assembly 10 matable with a pin header 50 by rack and pinion means. The plug connector assembly 10 includes a shield 26 in which an inner connector housing 16 containing receptacle terminals 12 is mounted. A lever 30 is mounted on the shield 26, and the lever includes pinion gear members 40, 44 that protrude from the side of lever arms 32. The pinion gear members engage rack gear members 70, 74 located on the interior of header walls 64. The rack gear members 70, 74 are laterally offset so that they can be molded using straight action mold tooling with no undercuts or side action. The lever pinion gears 40, 44 protrude so that they can engage the laterally offset rack gear members 70, 74.

9 Claims, 7 Drawing Sheets

FIG 3
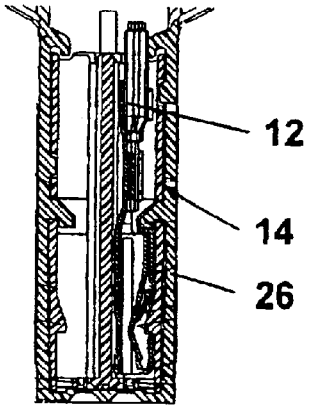
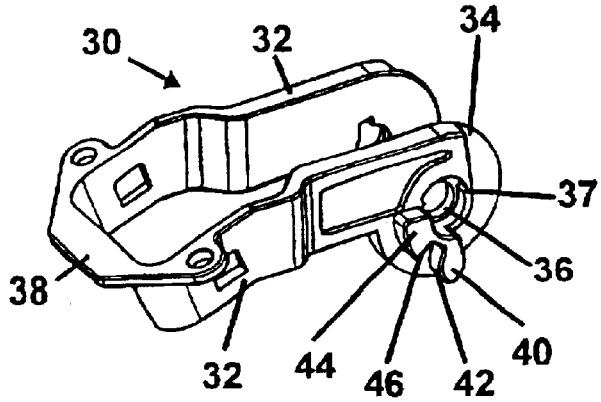
FIG 4
FIG 5
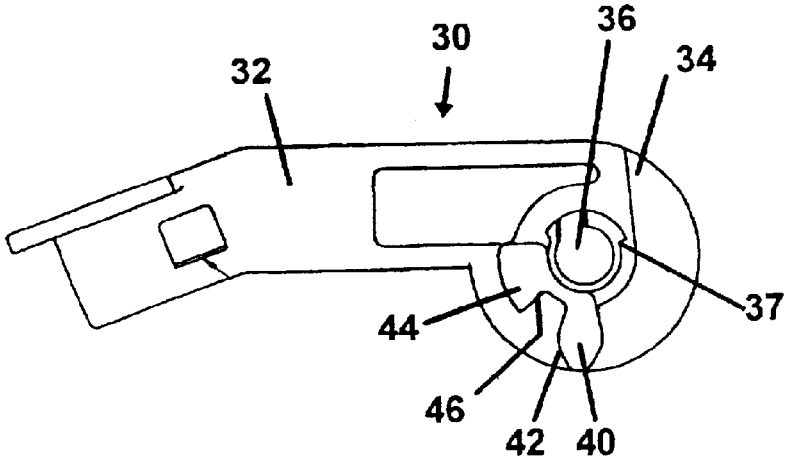

RACK AND PINION ELECTRICAL CONNECTOR WITH OFFSET GEAR TEETH

BACKGROUND OF THE INVENTION

1. Field of the Invention

This invention relates to electrical connectors that employ rack and pinion means on a lever to mate and unmate male and female electrical connectors. This invention is also related to electrical connectors that are used to mate wire harnesses to electrical components mounted in boxes, such as are typically used in automotive and other applications.

2. Description of the Prior Art

FIGS. 9 and 10 show a prior art rack and pinion electrical connector assembly as shown in DE 8714016 U. An electrical connector assembly of this type comprises a plug connector a that is matable with a pin header b, which has a shroud surrounding an array of printed circuit board pins. A rack and pinion and a lever c are used to supply a mechanical advantage when the two electrical connectors are mated or unmated. The rack d is located on the exterior surface of the plug connector a, which typically would include terminals attached to wires. The teeth forming the pinion e are located on the lever c so that the rack and pinion teeth intermesh as the lever is rotated about a pivot pin f, which is mounted in recesses on opposed side walls of the shroud surrounding the pins in the pin header b. Clockwise rotation of the lever c, as shown in FIGS. 9 and 10 unmates the two electrical connectors. It follows then that counter-clockwise rotation of the lever c will mate the two electrical connectors.

Similar prior art electrical connectors employ a lever mounted on the plug connector with the teeth forming a rack being located on interior sidewalls of a mating shrouded pin header. Mounting the lever on the plug connector has certain advantages. Access to the lever is improved if the lever is mounted on the plug connector, which is typically inserted into the pin header that is part of a previously installed component housing. Unfortunately it becomes more difficult to mold the teeth on an interior wall of a shrouded pin header. Inwardly shifting side action tooling is one way in which these teeth can be molded, but this is a relative expensive approach.

U.S. Pat. No. 5,322,448 discloses one approach to simplifying fabrication of teeth on a rack that are engaged by teeth on a lever that is inserted between racks on opposing side walls. In that configuration each rack projects above the upper edge of the pin connector housing in substantially coplanar relationship with the respective side wall of the pin connector housing shroud. The teeth of each rack overhang the respective shroud side wall. Although these teeth are easier to mold, some side action of the mold tooling is necessary as the pin header is removed from the mold. Furthermore, although this approach can reduce the width of the pin header and the electrical connector assembly, the height of the assembly in increased. In many applications the height of the assembly is more critical than its width. For example, the height of the connector assembly can be critical in many automotive applications where a low profile is preferred to a bulky connector and wire harness configuration.

U.S. Pat. No. 6,247,966 discloses a connector assembly in which the lever is mounted on a plug connector assembly to provide a relatively low profile assembly with a relatively narrow width. The rack teeth on this connector are located on the interior of the pin header shroud walls. However, in certain applications the pin header is part of a component housing, and often multiple pin headers need to be mounted on the same housing. When multiple pin headers are located in parallel relationship, it becomes very cumbersome to mold interior rack teeth in parallel relationship on separate side by side pin headers. One approach is to mold the rack teeth by inserting a pin through the sides of the header housing, but this approach does not lend itself to use with large components containing multiple headers. The instant invention provides a solution to this problem.

SUMMARY OF THE INVENTION

An electrical connector solving this problem would include a housing in which terminals are positioned. The connector also would include a lever rotatable relative to the housing to apply a mating and unmating force between the electrical connector and a mating electrical connector. The lever includes at least one gear tooth protruding laterally from a side of the lever so that the laterally protruding gear tooth can engage laterally spaced surfaces on the mating electrical connector.

The male electrical connector would be matable with and unmatable from a female electrical connector by rack an pinion means. The male electrical connector could include a lever rotatable relative to and mounted on the male connector housing. That lever would include pinion teeth for engaging laterally offset surfaces on a rack on the female electrical connector.

The two mating electrical connectors form an electrical connector assembly including rack and pinion mechanical assist means for mating and unmating the two electrical connectors. One electrical connector includes a molded housing defining a mating cavity in which at least part of another electrical connector is received when the two electrical connectors are mated. This molded housing includes oppositely facing and laterally offset rack surfaces exposed along the mating cavity.

The female electrical connector includes a molded housing and a plurality of terminals. The molded housing includes at least one side wall extending upward form a housing base with a plurality of gear members molded as part of an interior surface of the one side wall. Adjacent gear members are disposed one above the other relative to the housing base and laterally offset relative to each other in a direction perpendicular to the one side wall.

BRIEF DESCRIPTION OF THE DRAWINGS

FIG. 3 is a partial section view showing one of the receptacle terminals that located in the plug connector shown in FIGS. 1 and 2.

FIG. 4 is a three dimensional view of the lever that is used in the electrical connector assembly of FIGS. 1 and 2.

FIG. 5 is a side view of the lever also shown in FIG. 4.

DETAILED DESCRIPTION OF THE PREFERRED EMBODIMENT

Figure 8:
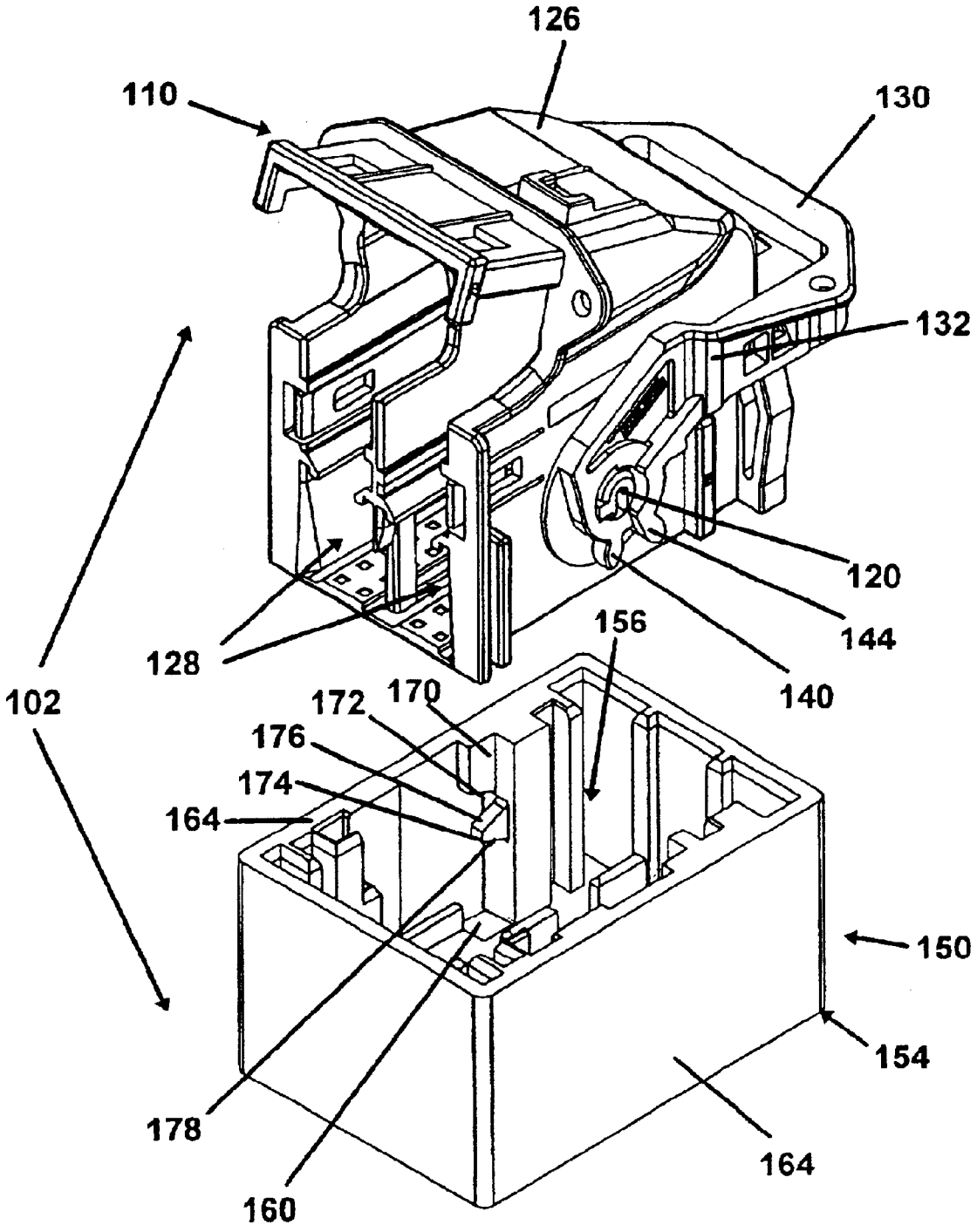
FIG. 8 is a view of a second embodiment of an electrical connector assembly in which one pinion gear member on the lever is offset relative to the other pinion gear member for engagement of mutually offset rack gear members on a pin header or mating electrical connector.
Figure 9:
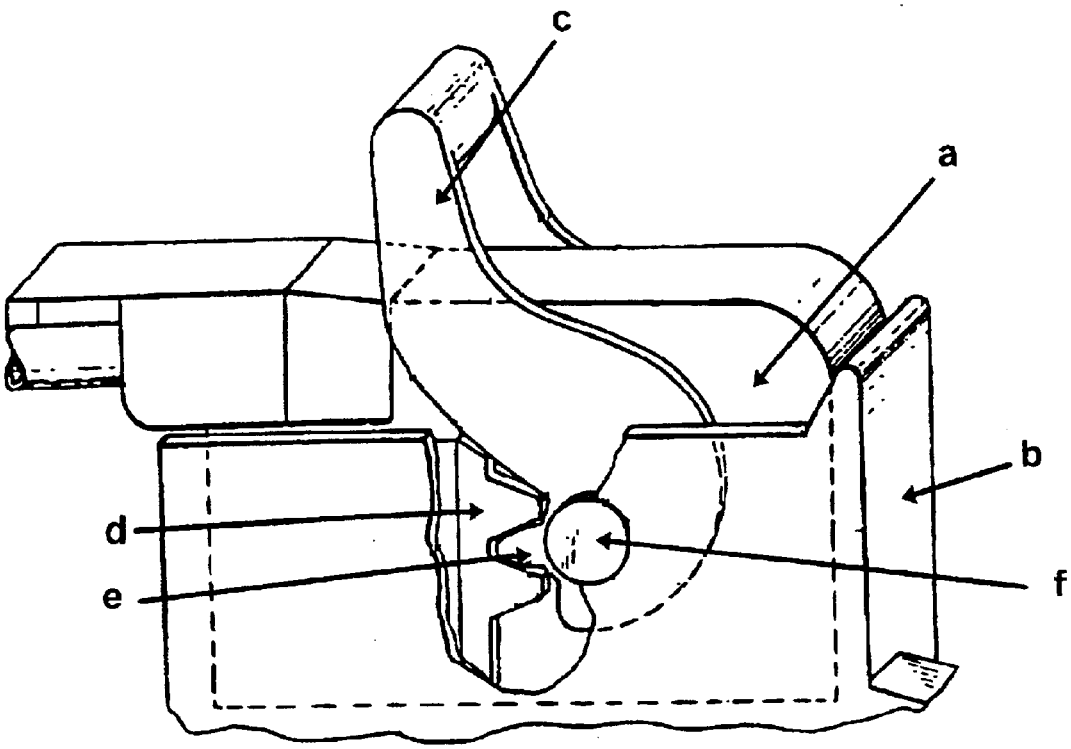
FIG 9 (PRIOR ART)
FIG. 9 is a view of the mated configuration of a prior art connector assembly employing rack and pinion means to mate and unmate the electrical connectors.
Figure 10:
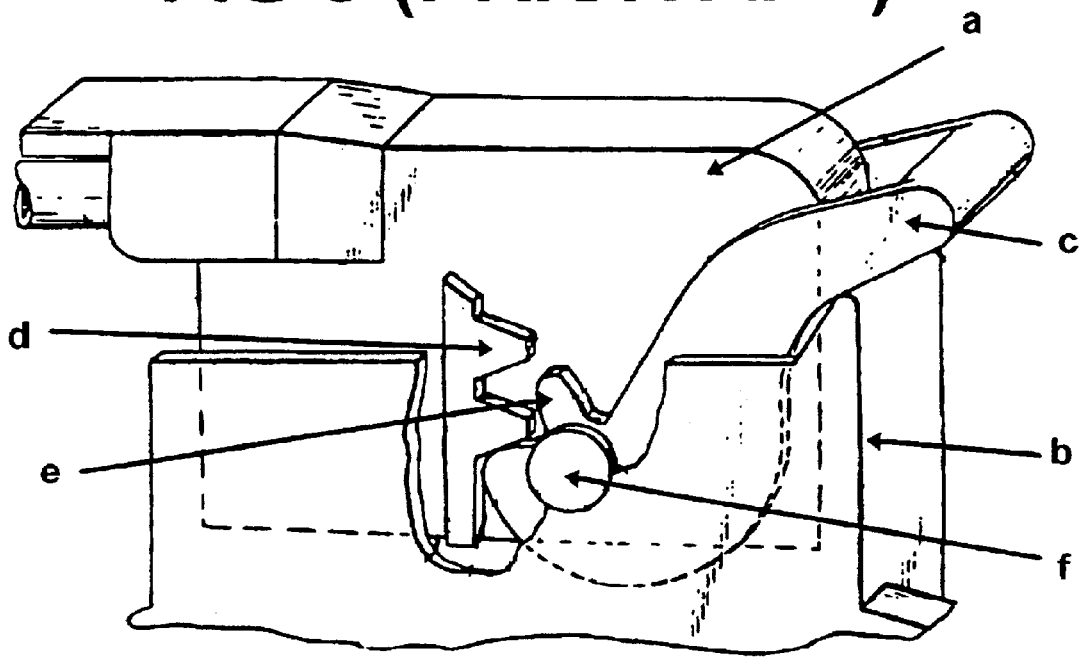
FIG 10 (PRIOR ART)
FIG. 10 is a view of the unmated configuration of the prior art electrical connector assembly also shown in FIG. 9.

Two representative embodiments of an electrical connector assembly employing rack and pinion means for providing a mechanical advantage to mate and unmate an electrical connector are depicted herein. The rack and pinion means employed in each of these embodiments translate rotary motion of the pinion gears into straight line movment of the two connectors along the direction of the rack gears. The first embodiment shown in FIGS. 1–5 shows an electrical connector assembly 2 including a plug or male connector 10 and a pin header or female connector 50. A lever 30 that is mounted on the plug connector 10 includes pinion gears including a mating gear tooth or member 40 and an unmating gear tooth or member 44 located adjacent the fulcrum of the lever 30. Both gear teeth or members 40, 44 protrude laterally from a side surface of lever arms 32. These pinion gear teeth 40, 44 engage rack gear members 70 and 74 on the pin header 50 which mates with the plug connector 10. FIG. 8 shown an embodiment of a similar connector assembly 102 that also employs pinion gear members 140 and 144 on a lever 130 to mate with rack gear members 170 and 174. In this embodiment only pinion gear member 144 protrudes from the side of the lever arm 132. Pinion gear member 144 also laterally protrudes from the other pinion gear 140. The laterally protruding gear members in both embodiments allow the gear pinion gear members 40, 44, 140, 144 to engage rack gear members that are mutually laterally offset. In the embodiment of FIGS. 1–5, rack gear member 70 is laterally offset relative to rack gear member 74. In the embodiment of FIG. 8, rack gear member 170 is laterally offset relative to rack gear member or tooth 174. When the rack gear members or teeth are laterally offset in this manner, the rack gears 70, 74 and 170, 174, and the pin headers 50 and 150 can be molded as one part by straight action mold tooling and no undercuts or side pulls are necessary to form the rack gear members. This greatly simplifies molding a cover or enclosure that may include more than one pin header as part of a one-piece molded part, because the part can also be molded by straight action tooling.

Figure 1:
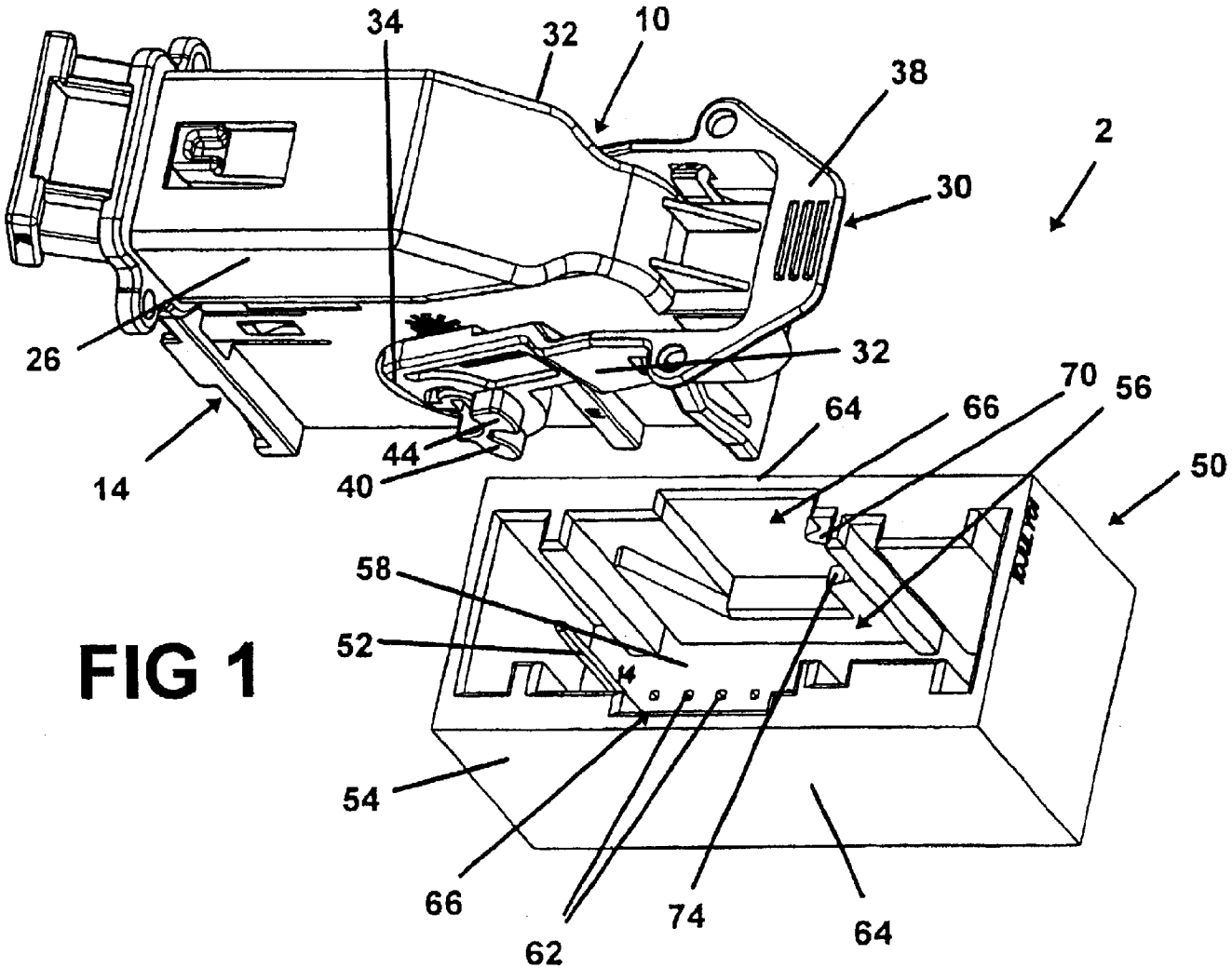
FIG. 1 is a three dimensional view of a preferred embodiment of an electrical connector assembly in which a plug connector can be mated and unmated with a pin header, or mating electrical connector, with the assist of rack and pinion means which move the plug connector in a straight line as it mates and unmates with the pin header.
Figure 2:
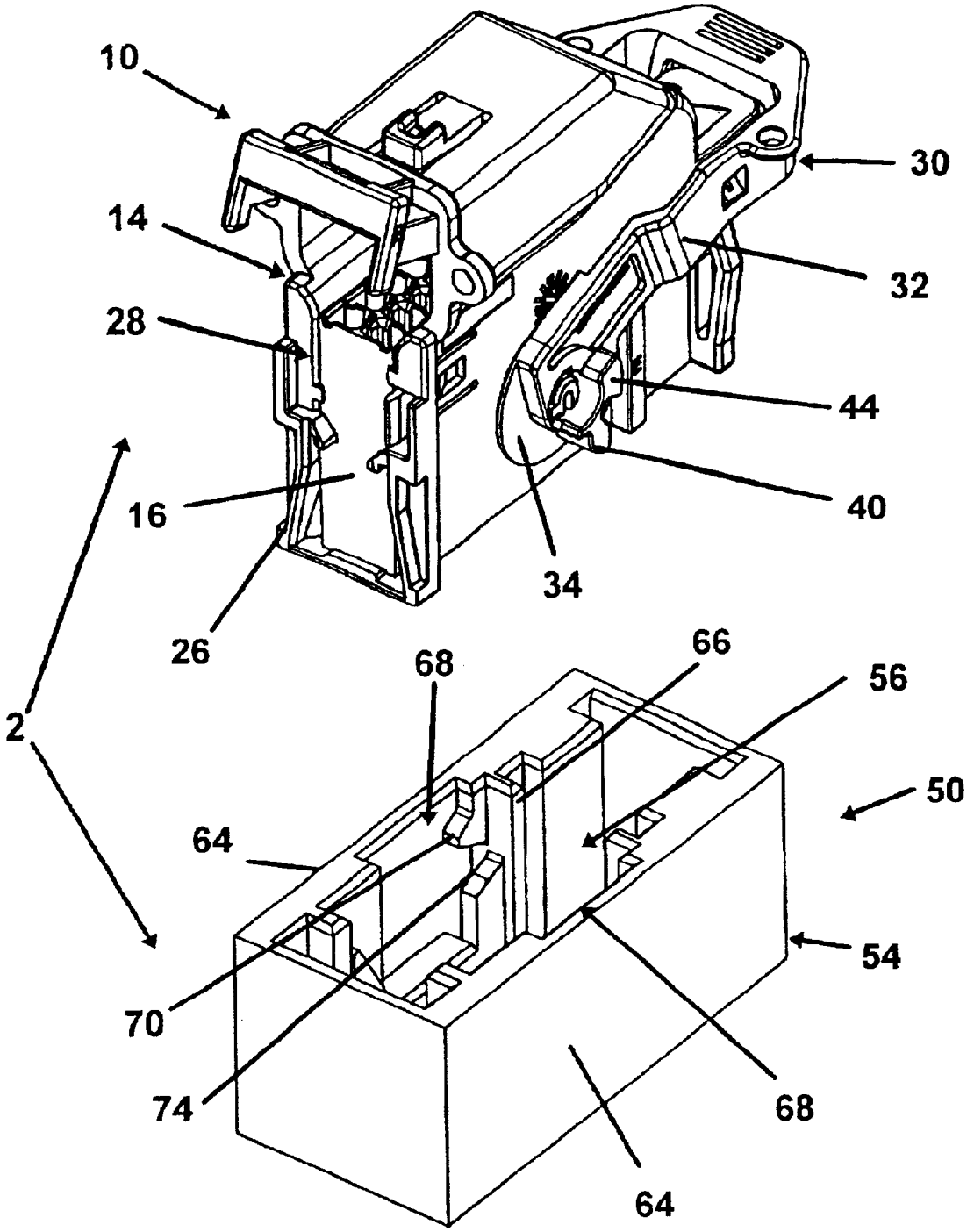
FIG. 2 is a similar three dimensional view of electrical connector assembly shown in FIG. 1, in which the components are viewed from a slightly different angle to show additional features of the assembly.

The electrical connector assembly 2, shown in FIG. 1, includes a plug connector 10 that is matable with a pin header 50. The plug connector 10 is an assembly of several components including a number of receptacle terminals 12, one of which is shown in FIG. 3, and a plug connector housing assembly 14. A molded inner plug connector housing 16, which can be seen in FIG. 2, is located in a compartment 28 on a molded plug connector shield housing 26. These two connector housing members 16 and 26 along with a lever 30, mounted on the shield housing 26, form the plug connector housing assembly 14. The inner plug connector housing 16 and the terminals 12 mounting in cavities therein are employed in other prior art electrical connectors, such as that shown in U.S. Pat. No. 6,247,966, which is incorporated herein by reference. These components are not critical to the invention described herein and need not therefore be described in further detail.

The molded shield or shield housing 26 shown in FIG. 1 has a shield compartment 38 having an open end through which an inner housing 16, with terminals 12 terminated to wires in a wire harness (not shown) can be inserted in conventional fashion. The shield 26 is in the shape of a three-sided shroud with two longer sides joined by a narrower rear side and a top section, all molded as a single piece. The bottom section of the shield 26 is open an forms a mating face on which the terminals 12 are exposed. This aspect of the shield 26 is conventional in nature and this mating face is only seen in FIG. 3. Opposite sides of the shield housing 26 include posts 20, which protrude so that a lever 30 can be mounted on the shield 26. It will of course be understood that only the post 20 on the front face is shown in FIGS. 1 and 2, and that an equivalent post is also located on the rear face, which cannot be seen in these three dimensional representative views. A distal post end 22 is laterally offset from the shield housing side from which the post 20 extends by a distance sufficient to mount the lever 30.

Lever 30 is shown in more detail in FIGS. 4 and 5. A single molded lever 30 is mounted on the shield 26, and this lever includes two generally parallel lever arms 32 joined at one end by a handle or cross member 38. Each lever arm 32 includes a generally circular hub section 34 located at the free ends of the arms. An opening 36 is centrally located within this hub section 34, and each opening 36 is dimensioned to receive a post 20 protruding from an adjacent side of the shield housing 26 so that the lever 30 can be mounted on the shield housing. Each opening 36 includes a stop surface 37 that engage stop shoulders on the corresponding post 20 so that the lever 30 can be rotated only through a specific arc.

The hub sections 34 of each lever arm 32 are generally flat and hub sections 34, and portions of the lever arms adjacent the free ends are generally parallel. Portions of the arms 32 adjacent to the handle or cross member 38 are offset relative to the hub sections in part to accommodate latching means that are not related to the instant invention and therefore need not be discussed. Pinion gear members protrude from the hub sections 34 and the portions of the lever arm generally proximate to the free ends of the lever arms 32. The pinion gears 40 and 44 also protrude beyond the distal end of the post 60, which forms the fulcrum of the lever 30. These gear members or teeth include a mating pinion gear tooth or member 40 and an unmating pinion gear tooth or member 44 located adjacent the circumference of the lever opening 36. These pinion gears will engage rack gear members 70 and 74 when the lever 30 is rotated to mate or unmate the two electrical connectors 10 and 50. The mating pinion gear member 40 has a gear surface or profile 42 that will engage a downwardly facing rack mating tooth surface or profile 72 when the lever 30 is rotated in a counter clockwise direction as seen in FIGS. 1 and 2 to move the plug connector 10 along a straight line into mating engagement with the pin header 50. The unmating pinion gear or tooth 44 has an exterior surface or profile 46 that will engage the upwardly facing rack gear surface 76 to unmate the plug connector 10 from the pin header 50 when the lever 30 is rotated in a clockwise direction. In both FIGS. 1 and 2, the lever 30 is positioned at the end of its clockwise travel relative to the shield 26 or in its fully unmated configuration. When the lever 30 is in this position, the plug connector 10 can be partially inserted into the mating cavity 56 of pin header 50 with terminals 12 in alignment with corresponding pins 52. The lever 30 can be rotated in a counter clockwise direction from this position causing the mating pinion gears 40 to engage the undersurface of the mating rack gears 70 along opposite sides of the pin header mating cavity 56 to fully mate the connectors and terminals. Although only one set of pinion gears or rack gears are visible in FIGS. 1 and 2, it should be understood that at least in the preferred embodiment pinion gears are located on opposite sides of the shield 26 and connector 10, and that rack gears are located on opposite sides of mating cavity 56 in pin header 50.

The pin header 50 shown in FIGS. 1 and 2 is a shrouded pin header having a mating cavity 56, formed by four walls extending upward from a base wall 58 to form a one piece molded housing 54. Electrically pins 52, one of which is shown in FIG. 1, extend upwardly through pin holes 62 in the header housing base 58. These pins 52 extend a sufficient distance upwardly into the mating cavity 56, so that the pins 52 will be engaged by receptacle terminals 12 when the plug connector 10 is mated to the pin header 50. In most applications, although not necessarily in all, the opposite ends of the pins will be terminated to a printed circuit board (not shown) located in an electrical or electronic component. Typically the pin header housing 54 will be molded as part of an outer housing of this electrical or electronic component, and often multiple, separate headers will be molded as part of the same component housing, enclosure or bulkhead.

Figure 6:
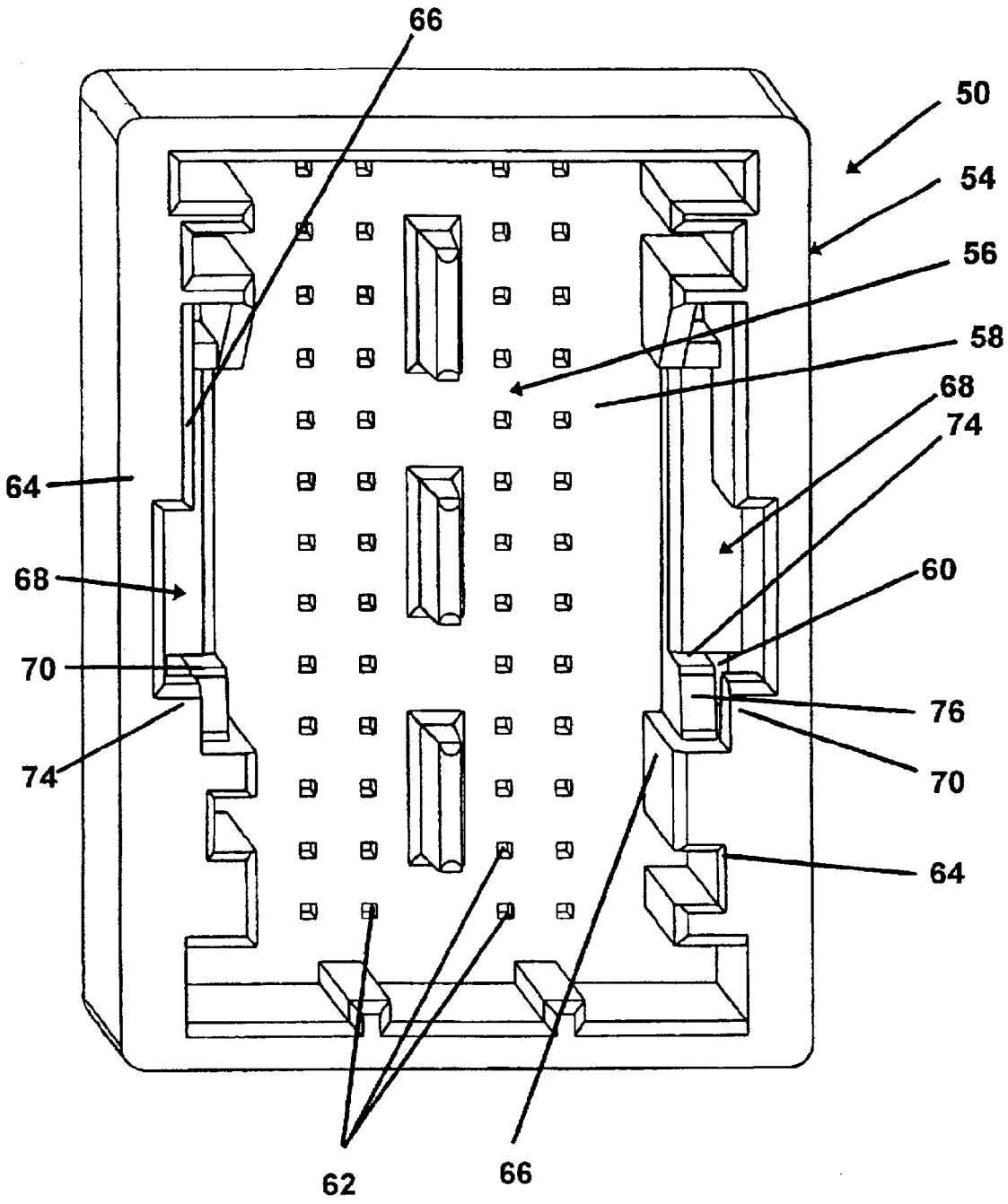
FIG. 6 is a view of the mating cavity of a pin header that can be used to mate with a plug connector using rack and pinion means of the type shown in FIGS. 1–5.
Figure 7:
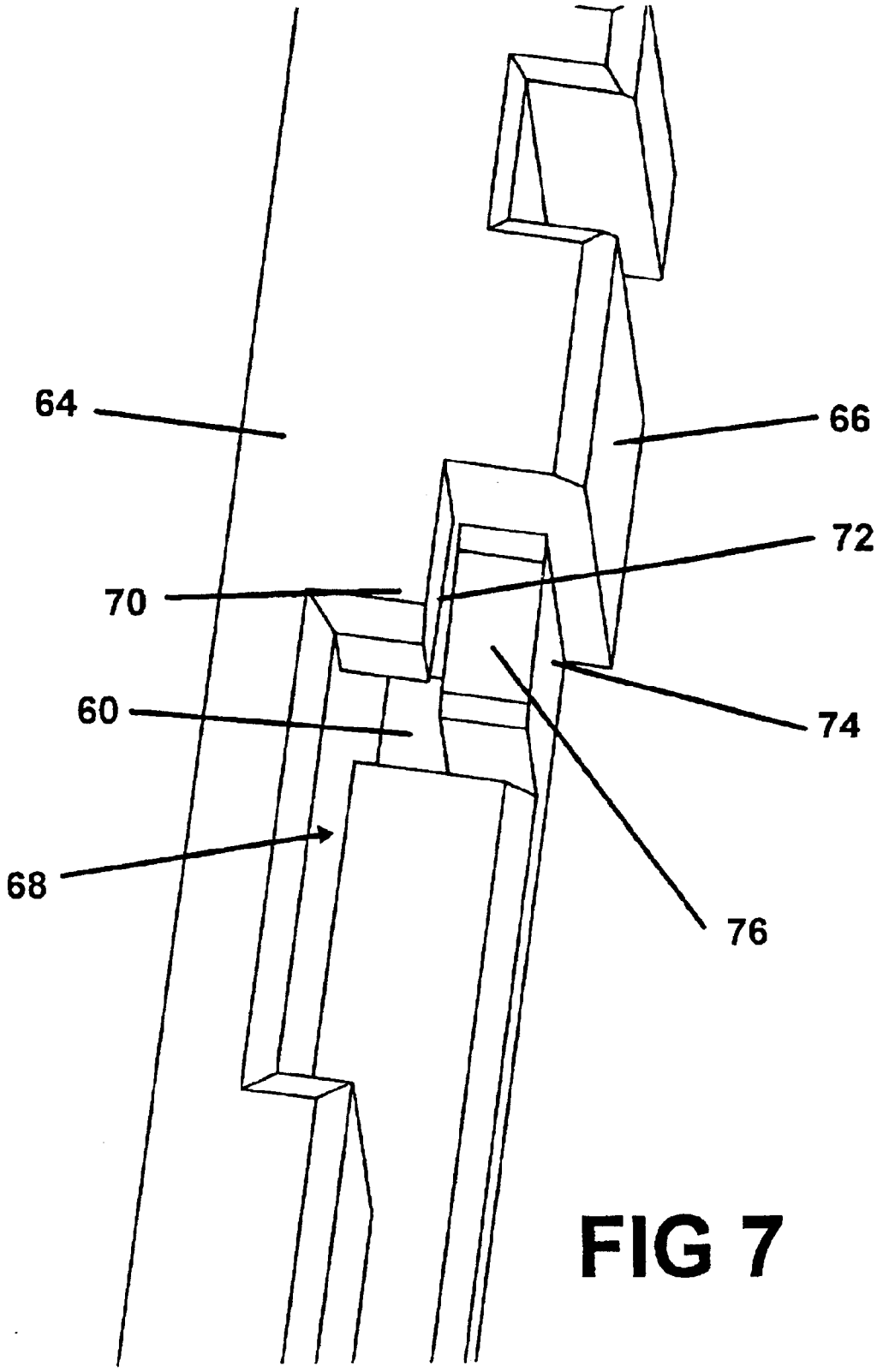
FIG. 7 is an enlarged view of one of the housing walls of the pin header of FIG. 6, in which the rack gears and the tool clearance hole aligned with one of the rack gears in shown in greater detail.

The pin header 50 shown in FIGS. 1 and 2 is a twenty-six position female electrical connector that is matable to a plug connector containing twenty-six terminals 12 in a single inner plug housing 16. The pin header housing 50, shown in FIG. 6 is a fifty-two position female connector matable to a plug connector containing two side by side inner plug housings 16, each of which contains twenty six terminals. In each case, a single shield 26 contains the inner connector housings 16, although of course the size or width of the shield 26 will be different for connectors having different numbers of terminals. It should be understood, however, that the instant invention is not limited to connectors of a specific size or having a specific number of terminals. Pin headers of different sizes are shown in FIGS. 1, 2, and FIG. 6, only because these views better illustrate the details of the basic pin header configuration.

Pin header 50 has a generally rectangular configuration with opposite side walls 64 each having a rack recess 68 formed on an interior surface 66 of the wall 64. These rack recesses 68, and the rack gear members 70 and 74 formed therein, thus extend along the irregularly shaped sides of the mating cavity 56. Rack gear members 70 and 74 are formed, along one edge of each rack recess 68. Although the two rack gear members are located at different heights relative to the pin header base wall 58, as would be the case with conventional rack gear configurations, the rack gear members 70 and 74 are not aligned, one above the other, as would be the case in a conventional rack gear arrangement. The mating gear member or tooth 70 is laterally offset relative to the unmating rack gear member or tooth 74. In both the embodiment of FIGS. 1 and 2, and the embodiment of FIG. 8, the mating rack gear 70 and its downwardly facing surface or profile 72 are closer to the exterior of the corresponding header housing wall 64 than the unmating rack gear 76 and upwardly facing surface or profile 76. In other words, the unmating rack gear 76 and the unmating gear profile surface 76 are located closer to the remainder of the mating cavity 56. Stated differently, the mating rack gear 70 is laterally offset relative to the unmating rack gear 74. The width of each rack gear is less than the width of the recess 68, and in the representative embodiment the width of each rack gear is approximately equal to half the width of the recess 68. This lateral offset is employed so that both of the gear members 70 and 74 can be molded, as part of the pin header housing 54, by using straight action tooling that moves perpendicular to the base wall 58 when mold tooling is separated to remove the one piece molded pin header housing 54 from a mold. Side action tooling is not needed to form the oppositely facing rack gear surfaces or profiles 72 and 76, because these surfaces do not overlap. The downwardly facing mating gear surface or profile 72 is instead aligned with a mold tool clearance opening 60 formed in the bottom of the rack recess 68. A projection on the mold tooling would form the downwardly facing surface 72 when the mold is filled and would leave this opening 60 when the newly molded pin header housing 50 is removed from the mold tooling and from this mold tooling projection. An oppositely extending mold projection, on the other half of the mold would form the adjacent upwardly facing gear profile 76. Thus the two rack gear members 70 and 74, and their working profiles or surfaces 72 and 76 would be side by side instead of overlapping in a normal rack configuration.

Neither the mating rack gear 70 or the unmating rack gear 74 has the fully formed shape of a gear tooth that would be characteristic of a fully formed rack having more that two rack gear teeth. For the represent electrical connector assemblies depicted herein, two rack gears, and two pinion gears are sufficient to fully mate the plug connector 10 to the pin header 50. It is therefore not necessary to form a gear profile surface on the reverse side of each rack gear. The portion of the wall opposite the working rack surface can then be extended to the top or bottom of the pin header housing 54 resulting in a stronger molded gear member. Although the rack gear members 70 and 74 may not have a completely developed tooth configuration, it is believe appropriate to refer to these two member as rack gear members, because in combination with the pinion gear members 40 and 44, they result in straight line movement of the plug connector 10 relative to the pin header 50 during mating and unmating. In other applications more than two rack members may be necessary for adequate mating and unmating travel. Three or more rack gear members could be molded in the same manner by laterally offsetting all of the rack gears.

An alternative embodiment of an electrical connector assembly 102, and of a rack and pinion configuration for mating plug connector 110 to pin header 150 is shown in FIG. 8. The plug connector 110 is representative of a configuration in which two inner housings, of the same configuration as those shown in FIG. 2, can be inserted into side by side compartments 128 of a shield 126. A single U-shaped lever 130 is mounted on the shield 126 with lever arms 132 extending along the sides of the shield 126. The lever 130 is mounted on posts 120 extending from the sides of the shield, with only the front side and front post 120 shown in FIG. 8. Unlike the version shown in FIGS. 1 and 2, the mating pinion gear 140 is formed as an extension in the same plane as the adjacent sections of the lever arm 132, and is not laterally offset relative to the lever arm 132 or relative to the distal end of post 120 as in the earlier configuration. The unmating pinion gear 144 is, however, laterally offset relative to the post 120 the arm 132, and also relative to the plane of the mating pinion gear 140. This will allow unmating pinion gear 144 to engage a rack gear 174 that is lately offset relative to a mating rack gear 170 that is engaged by the mating pinion gear 140. These offset rack gears 170 and 174 are formed on the pin header side wall 164 in the one piece molded header housing 154. The gear teeth 170 and 174 are therefore exposed in the mating cavity 156 in substantially the same manner as in the embodiment of FIGS. 1 and 2. One other difference is that in the embodiment of FIG. 8 is that not only will a downwardly facing surface 172 on the mating rack gear 170 be formed by mold tooling extending upwardly to leave a clearance opening 160, but a lower surface 178 will also be formed on the unmating gear tooth 174.

The representative embodiments of this invention are intended for use in automotive applications in which multiple wire harnesses are attached to a single component or to a single enclosure containing multiple components. Of course a single header could also be molded in accordance with the principles of this invention. In these applications the female electrical connector is normally a printed circuit board connector that is mounted on a printed circuit board or an input/output printed circuit board in the electrical component. It should be understood however that the female connector is not necessarily a printed circuit board connector, and that the invention would be applicable to two connectors, both terminated to wires or other conductors. Connectors incorporating this invention could also be used in other applications and are not limited to use in automobiles or motor vehicles. The invention is therefore defined by the following claims and the specific embodiments are merely representative of this invention.

We claim:

1. An electrical connector assembly, comprising:

a first connector having a side wall and having first and second rack gears formed on and extending inward from an interior surface of the side wall, the first and second rack gears protruding different distances from the interior surface of the side wall; and a second connector mating with the first connector, the second connector having a housing and a lever rotatable relative to the housing, the lever including first and second gear teeth protruding laterally beyond a side surface of the lever, the first and second gear teeth being offset different distances from the side surface of the lever, the first and second gear teeth aligning with and engaging the first and second rack gears, respectively, to apply a mating and unmating force between the first and second connectors.

2. The electrical connector assembly of claim 1 wherein the lever includes two arms extending along opposite sides of the housing of the second connector, each of the arms including a pair of the first and second gear teeth protruding laterally from a corresponding side surface of each lever arm.

3. The electrical connector assembly of claim 2 wherein the lever is mounted on an outer housing shield surrounding the housing containing a plurality of terminals.

4. The electrical connector assembly of claim 3 wherein the lever arms include holes and the housing shield includes posts extending from opposite walls of the housing, the lever arm holes receiving the posts when the lever is mounted on the outer housing shield.

5. The electrical connector assembly of claim 4 wherein at least one gear tooth protrudes laterally beyond a distal end of each post on which the lever is mounted.

6. The electrical connector assembly of claim 1 wherein the first and second gear teeth comprise means for engaging two laterally and longitudinally offset surfaces on the first and second rack gears on the second electrical connector.

7. The electrical connector assembly of claim 1 wherein the first gear tooth is positioned to engage a downwardly facing surface on the first rack gear and the second gear tooth is positioned to engage an upwardly facing surface on the second rack gear.

8. The electrical connector assembly of claim 1 wherein the first connector includes a molded housing defining a mating cavity in which at least part of the second connector is received when the first and second connectors are mated, the molded housing including the first and second rack gears arranged as oppositely facing rack surfaces exposed along the mating cavity, said rack surfaces being laterally offset from one another.

9. The electrical connector assembly of claim 1 wherein the first rack gear has a surface formed along the side wall projecting upwardly from a base of the first connector.

* * * * *